US005439222A

United States Patent [19]

Kranenberg

[11] Patent Number: 5,439,222

[45] Date of Patent: Aug. 8, 1995

[54] TABLE BALANCED, ADJUSTABLE MOMENT OF INERTIA, VIBRATIONALLY TUNED PUTTER

[76] Inventor: Christian F. Kranenberg, 1601 Tijeras NE. #20, Albuquerque, N. Mex. 87106

[21] Appl. No.: 291,189

[22] Filed: Aug. 16, 1994

[51] Int. Cl.[6] ..... A63B 53/04; A63B 53/02

[52] U.S. Cl. ..... 273/167 G; 273/171; 273/80 C; 273/167 F

[58] Field of Search ..... 273/167 R, 169, 171, 273/167 D, 167 F, 80 C, 80.2

[56] References Cited

U.S. PATENT DOCUMENTS

| | | | |
|---|---|---|---|
| 3,625,517 | 12/1971 | Durnack | 273/167 |
| 4,325,553 | 4/1982 | Taylor | 273/167 F |
| 4,714,252 | 12/1987 | Roraback | 273/171 |
| 4,828,266 | 5/1989 | Tunstall | 273/171 |
| 4,852,879 | 8/1989 | Collins | 273/164 |
| 4,872,684 | 10/1989 | Dippel | 273/164 |
| 4,898,387 | 2/1990 | Finney | 273/167 F |
| 4,962,932 | 6/1990 | Anderson | 273/171 |
| 4,984,799 | 1/1991 | Finney | 273/169 |
| 4,995,612 | 2/1991 | Finney | 273/169 |
| 5,078,398 | 1/1992 | Reed et al. | 273/80 C |
| 5,131,656 | 7/1992 | Kinoshita | 273/164 |
| 5,133,555 | 7/1992 | Bailey | 273/164 |
| 5,275,412 | 12/1994 | Innes | 273/164.1 |

OTHER PUBLICATIONS

"Golf Digest", Penny Putter, Apr. 1974, pp. 122, 273/167F.

*Primary Examiner*—Vincent Millin
*Assistant Examiner*—William M. Pierce

[57] ABSTRACT

An improved golf putter is disclosed in which a heel and toe weighted putter head, hosel, and shaft are configured such that the putter's mass is equally bisected by a vertical plane intersecting the heel and toe regions of the putter head and having the longitudinal axis of the shaft lie in that plane. This configuration provides a table balanced feature to the golf putter. Deterministically positioned weights of varying masses in the heel and toe regions produce expected changes in the moment of inertia of the putter head without changing the balanced feature of the putter. Many hosel positions and shaft lie angles can be obtained without defeating the table balanced feature. Vibrational tuning of the putter head is achieved by preloading of the deterministically positioned weights.

9 Claims, 2 Drawing Sheets

TABLE BALANCED, ADJUSTABLE MOMENT OF INERTIA, VIBRATIONALLY TUNED PUTTER

FIELD OF THE INVENTION

This invention pertains to the game of golf, specifically to golf putters.

BACKGROUND OF THE INVENTION

There are many variables involved when striking a golf ball with a putter. Some of these variables are independent with respect to putter design, such as putting surface irregularities and individual putting techniques. However, the functional design of a putter can aid in the accuracy of striking a golf ball toward an intended target with desired linear and rotational velocities. Some previous putter designs have utilized unique balancing schemes of a putter head, and incorporated large moments of inertia or radii of gyration of the putter head about a specified point of rotation. It is generally known that the comfort and aesthetics of a putter are considered important to a golfer. Many putters have been designed with these functional and aesthetic qualities in mind. The above design features and other attributes of a putter can be classified as controllable variables. Many putters have addressed one or more controllable variables from a static and/or dynamic viewpoint in an attempt to improve the accuracy of a golfer's putting stroke. One such controllable variable is shaft location with respect to a putter head. Critical alignment of a shaft with one or more certain features of a putter head can improve the accuracy of a putting stroke.

For example, one prior putter, U.S. Pat. No. 5,131,656, describes a gravity balanced and faced balanced arrangement. When the centerline of the shaft extends through the center of gravity of the putter head the condition is defined as gravity balanced. A gravity balanced putter eliminates any torquing about the shaft axis caused by the force of gravity. When the putter face is horizontally upward, and the sum of the moments about the shaft centerline passing through the putter head are zero, the putter is defined as faced balanced. A faced balanced putter is claimed to produce zero torquing of the putter head about the shaft axis during the acceleration of the putter head through the impact zone. There are several disadvantages associated with the foregoing conditions. Firstly, the placement of the shaft must satisfy the two balanced conditions just described. This places strict limitations on the position of the shaft with respect to the putter head. These restricted shaft positions can be uncomfortable to a golfer. Secondly, a face balanced putter provides its balanced feature only during the portion of the stroke when the putter head is traveling forward and upward. During the backstroke of a pendulum puffing stroke the face is pointing toward the ground. This situation produces an unbalanced condition and torques due to the force of gravity will result. The outcome is a twisting force imparted to the putter head that can change the intended orientation of the putter face.

Another prior putter, U.S. Pat. No. 5,078,398, states that a shaft axis passing through the center of gravity and strike point of a putter head will impart minimal angular acceleration to the putter head during impact with a golf ball. The above patent also describes a putter shaft axis that passes through the center of gravity of the putter head and the center of gravity of the entire putter. This feature eliminates any unwanted static forces thereby providing "an infinitely balanced" putter. There are several disadvantages associated with this type of balancing scheme. First, this design results in a golfers hands being approximately six inches behind the putter face when addressing a ball. This address position is not commonly accepted; most golfers prefer a putter that provides a hand position in a region directly over the ball. If it is desired to change the lie angle of the shaft by repositioning the hosel stem relative to the club body, the balanced feature of the putter is lost. Secondly, the center of gravity of the entire putter changes once a golfer has gripped a putter. When a golfer is linked with a putter, additional mass is coupled with the entire putter. This additionally linked mass in the form of hands, arms, shoulders, and other moving body parts of a golfer, defines a new and unique system. The new system consists of the pertinent body parts of the golfer and the entire putter. This new system has a center of gravity different from the center of gravity of the entire putter. The center of gravity of the new system is unique to the individual golfer. As a result of this uniqueness, the center of gravity of the system does not necessarily pass through the shaft axis. Therefore, the balanced feature of this putter design is lost. Consequently, it becomes unnecessary to place a constraint on a shaft axis passing through the center of gravity of the entire putter.

Another known putter balancing scheme is the table balanced design. This is where the putter is laid upon a horizontal surface with the club head hanging freely beyond the edge, the putter comes to rest with its striking face aligned vertically. Prior putters, such as U.S. Pat. No. 3,625,517 and U.S. Pat. No. 4,163,554 are examples of table balanced putters. However, the above patents do not incorporate heel and toe weighting for an increased moment of inertia.

The weight distribution of a putter head is an important factor in controlling the amount of twisting force or torque of a putter head during the stroke of the putter. Generally, the majority of the weight in a high moment of inertia putter head is located at the heel and toe regions. This configuration increases the moment of inertia about a point of rotation between the major weight areas. A putter with an increased moment of inertia can reduce the amount of twisting of the putter face during the stroke of the putter. For example, U.S. Pat. No. 4,898,387 cites a putter head with a high moment of inertia. However, there are no built in means of varying the moment of inertia or mass of the club to the personal preference of a golfer. Also, no specific placement of the putter shaft is described to provide a balanced effect. Adjustable weighting schemes have provided built-in custom weighting. Specifically, U.S. Pat. Nos. 4,962,932 and 4,872,684 utilize interchangeable weights at the heel and toe sections of a putter head to satisfy the weighting requirements of an individual golfer. Generally, a golfer will increase the weighting in the heel and toe sections of a putter head with the expectation of increasing the moment of inertia of the putter head. The moment of inertia is defined by two parameters; proportional to the mass of a weight, and proportional to the square of the distance form the mass elements of the weight to a point of rotation. The point of rotation is taken somewhere between the heel and toe sections of the putter head. This definition states that the location of the weight is an important factor. The weights of the above mentioned designs are inserted such that the long axes of the weights are parallel to the face of the putter head. However, this weight alignment can produce unexpected results. The different weights posses different lengths thereby changing the two moment of inertia parameters for a putter head. Consider replacing a lighter (and shorter) for a heavier (and longer) weight in the above mentioned putters. The mass contribution to the moment of inertia will increase. However, the mass distribution of the weight will be shifted towards the point of rotation of the putter head. This shift decreases the distance between the mass elements of the weight and the point of rotation of the putter head. The decreased distance contribution can be larger than the increased mass contribution. Therefore, it is possible to decrease the moment of inertia of a putter head by increasing the weights in the heel and toe of the aforementioned putters. This is an unexpected result. Other adjustable weighted putters have eliminated this unexpected result.

One putter head, U.S. Pat. No. 4,325,553, uses adjustable threaded heel and toe weights such that the long axes of the weights are parallel to the stroke direction of the putter. This scheme produces a constant distance of the mass distribution with respect to a point of rotation regardless of the weights used. Therefore, the moment of inertia of the putter about a designated point changes in an expected manner. However, this putter requires the same mass be inserted in the heel and toe weight receptacles. If a different mass is placed in the heel weight receptacle with respect to the toe weight receptacle, the balanced features of the putter are lost. This constraint on weighting the putter restricts the golfer's individual weighting desires.

The "feel" of a putter produced as a result of impact with a golf ball is an important attribute to a golfer. Prior putters have mass regions deterministically located and may have specific putter head shapes and materials to obtain what a golfer considers a good "feel."One such putter, U.S. Pat. No. 5,131,656, describes a putter with specific mass placement and structural design to promote a solid feel. However, the feel or vibration of this putter is not adjustable. Prior putters have their own vibrational characteristics that are invariant to that putter. No prior an has been witnessed by myself that allows a golfer to adjust in an expected manner the vibrational characteristics of a putter resulting from striking a golf ball.

Objects and Advantages of the Invention

Accordingly, several objects and advantages of my putter are:

(a) To promote a smooth pendulum putting stroke that imparts overspin and minimal angular deviation to a golf ball after impact with a heel and toe weighted putter through a single required constraint of a shaft, and to provide a wide range of shaft positions. Prior art, such as U.S. Pat. No. 5,131,656, describes a gravity balanced and faced balanced putter. Such conditions claim to eliminate any torquing about the shaft axis due to gravity, and any torquing through the impact zone. Yet limitations are placed on the position of the shaft with respect to the putter head, and face balancing can produce twisting of the putter head during a pendulum backstroke. Additionally, U.S. Pat. No. 5,078,398 does not take into account the effect of a putter's balancing in the hands of a golfer. This leads to unnecessary constraints being placed on the shaft location. The present invention has the advantages of placing a shaft and adjusting the lie angle of a shaft in numerous positions while retaining the balanced feature of the putter. The only requirement is that the shaft axis remain in one designated plane. This one requirement maintains what is termed a table balanced condition for a putter. This balancing scheme promotes a pendulum type stroke that imparts overspin, and assures that the putter face will return back to square and strike the golf ball on its intended line. Therefore, the personal preference of a golfer concerning shaft position can be satisfied without defeating the desired balanced feature of the putter.

(b) To provide heel and toe adjustable weighting without changing the balanced feature of a putter, and to change the moment of inertia of a putter head in an expected manner. Previous putters, such as U.S. Pat. Nos. 4,962,932 and 4,872,684, can change the moment of inertia of a putter head in an unexpected manner. Additionally, U.S. Pat. No. 4,325,553 requires that similar weights be placed in the heel and toe sections of a putter head to maintain the balanced features of the putter. No such restrictions are imposed on the present invention.

(c) To provide vibrational tuning of a putter. One has the advantage of tuning the vibrational characteristics of a putter to a desirable "feel."No prior putter has this advantage.

Further objects and advantages will become apparent upon further consideration of the drawings and ensuing description of the invention.

SUMMARY OF THE INVENTION

The present invention assures that the balanced feature of a heel and toe weighted putter is maintained while allowing many shaft positions and lie angles. The table balanced feature assures that the putter face will come back to square and strike the golf ball on its intended line. This type of balancing along with shaft position promotes a pendulum type swing that imparts overspin to the golf ball. Overspin is desirable to reduce the effects of putting surface irregularities from influencing the direction of the golf ball. The ability to adjust the heel and toe weighting of the putter head allows the golfer to choose a comfortably weighted club, and change the moment of inertia of the club in an expected way without defeating the table balanced feature. Different weights can be placed in the heel and toe regions without losing the table balanced feature of the putter. The "feel" of a putter striking a golf ball is an important feature, and the present invention provides adjustment to its vibrational characteristics.

DETAILED DESCRIPTION OF THE PREFERRED EMBODIMENT

Figure 1:
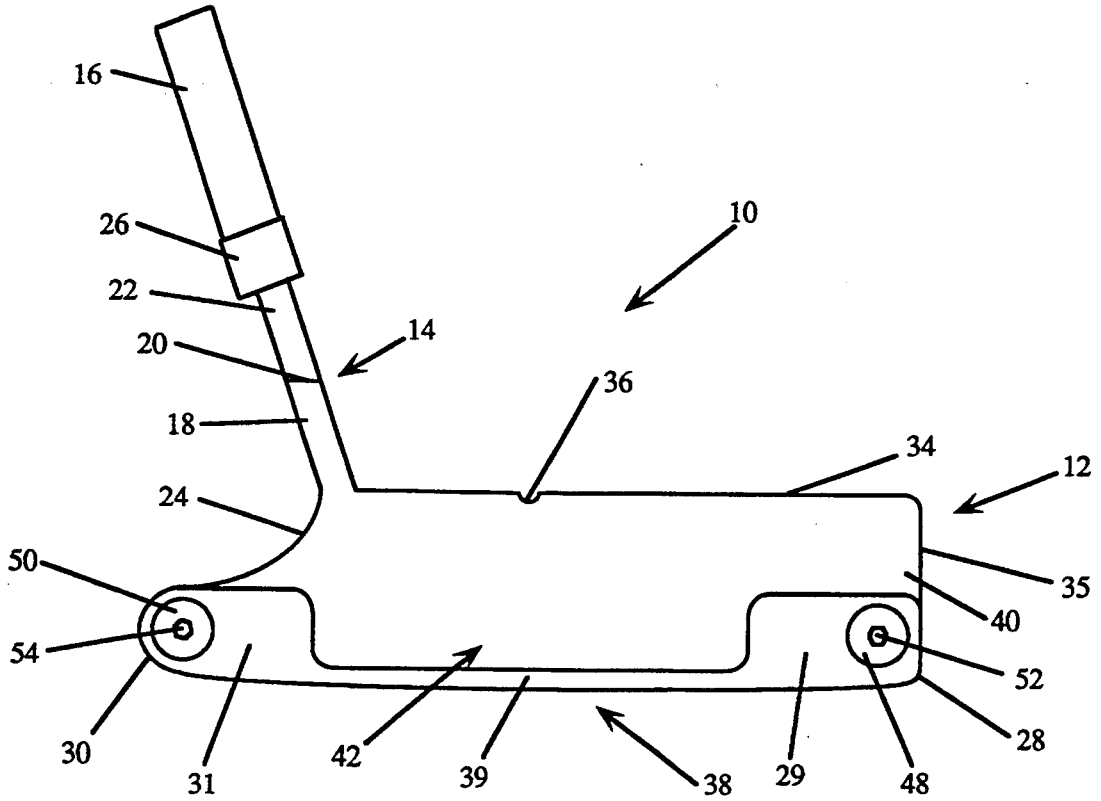
FIG. 1 is a rear elevation of the putter head with a truncated shaft of the present invention.
Figure 2:
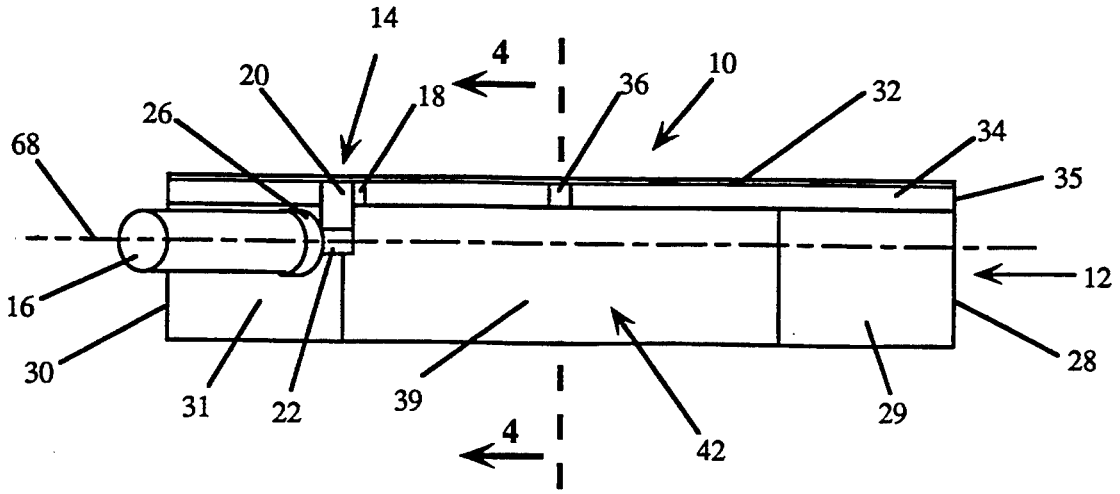
FIG. 2 is a top plane view of the present invention.

FIGS. 1–4 of the drawings disclose a golf putter which embodies the general principles of the invention. Referring to FIGS. 1–2, a putter head 10 is comprised of a body section 12 and a hosel section 14 integrally formed therewith. Hosel section 14 comprises an upwardly directed lower hosel stem 18 with a hosel offset 20 directed horizontally rearward from the termination of hosel stem 18. An upper hosel stem 22 extends upwardly from the termination of hosel offset 20. A shaft socket or hosel barrel 26 extends from the termination of upper hosel stem 22 for receiving a shaft 16 (truncated) whose lower tip is secured in a well known fashion. A center of mass plane 68, designates equal amounts of mass of putter head 10 on either side of said center of mass plane 68. The horizontal length of hosel offset 20 positions the longitudinal center line of upper hosel stem 22 to lie in center of mass plane 68.

Body section 12 has a generally elongated shape, extending from a toe 28 to a heel 30 along a sole surface 38. Sole surface 38 typically has a convex shape to prevent snagging during a putting stroke. Body section 12 is further comprised of a front striking face 32 and a rear face 40. A slightly radiused lower front edge 44 defines the transition surface between front striking face 32 and sole surface 38. A toe edge 35, a generally planar top edge surface 34, and a hosel base 24 define the transition surfaces from front striking face 32 to rear face 40. An alignment groove 36 transverse to rear face 40 is located midway between toe 28 and heel 30 on top edge surface 34. Extending rearward from rear face 40 is a toe mass 29, a heel mass 31, and a thin wall 39. Sole surface 38 defines the bottom portions of toe mass 29, heel mass 31, and thin wall 39. A rear cavity section 42 has boundaries defined by rear face 40, toe mass 29, heel mass 31, and thin wall 39.

Figure 3:
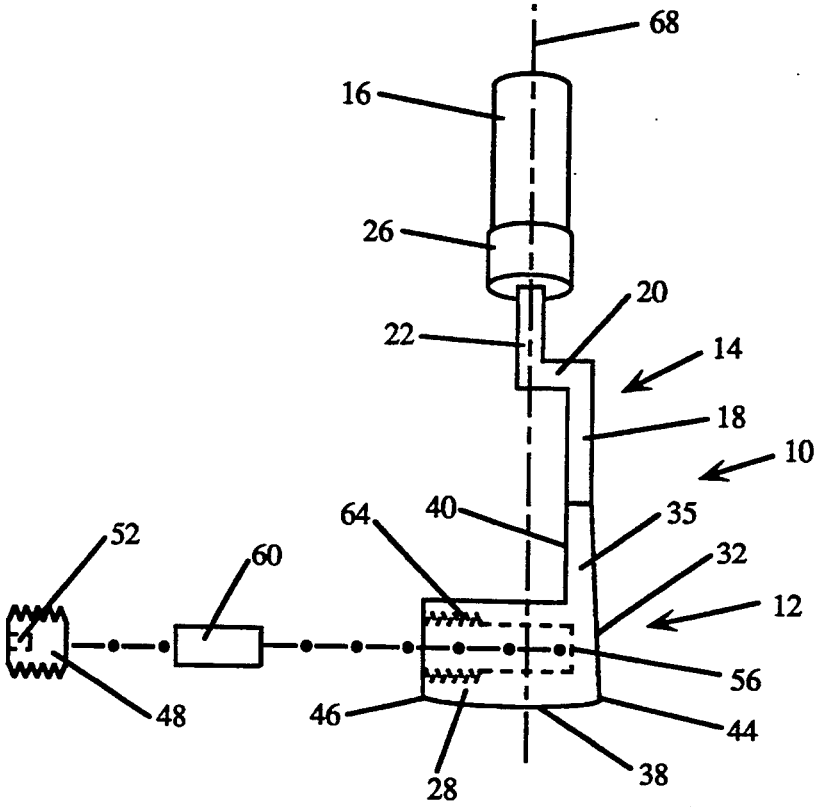
FIG. 3 is a toe view of the present invention.

Referring to FIG. 3, putter head 10 further comprises a cylindrical toe weight chamber 56 located in toe mass 29 whose long cylindrical or longitudinal axis is normal to rear face 40. Additionally, toe weight chamber 56 receives a toe weight 60 of like longitudinal dimension as toe weight chamber 56 such that toe weight 60 is bisected by center of mass plane 68. A threaded toe weight plug 48 with a toe weight plug hex head wrench socket 52 is screwed into a similarly threaded toe weight plug receptacle 64 to secure toe weight 60 in toe weight chamber 56.

Figure 4:
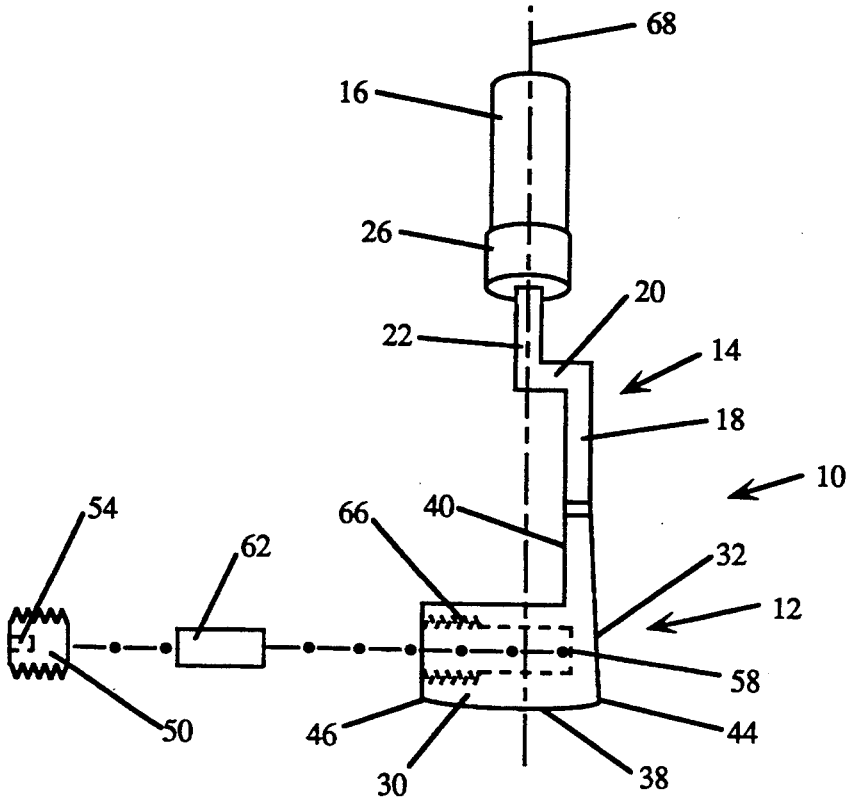
FIG. 4 is a sectional view of FIG. 1.

Referring to the sectional view of FIG. 4, putter head 10 further comprises a cylindrical heel weight chamber 58 located in heel mass 31 whose long cylindrical or longitudinal axis is normal to rear face 40. Additionally, heel weight chamber 58 receives a heel weight 62 of like longitudinal dimension as heel weight chamber 58 such that heel weight 62 is bisected by center of mass plane 68. A threaded heel weight plug 50 with a heel weight plug hex head wrench socket 54 is screwed into a similarly threaded heel weight plug receptacle 66 to secure heel weight 62 in heel weight chamber 58.

The position of upper hosel stem 22 determined by hosel offset 20 such that the longitudinal centerline of upper hosel stem 22 lies in center of mass plane 68 produces the desired table balanced requirement of the invention. Toe weight chamber 56 and heel weight chamber 58 have their longitudinal axes bisected by center of mass plane 68 such that when toe weight 60 and heel weight 62 are secured in respective weight chambers 56 and 58 their longitudinal axes are bisected. This bisection insures that the table balanced feature of the preferred embodiment is not altered. Toe weight 60 and heel weight 62 when secured in respective weight chambers 56 and 58 provide adjustable toe and heel weighting and produce an expected change in the moment of inertia of the preferred embodiment. Vibrational tuning of the preferred embodiment is achieved by adjustable preloading of toe weight 60 and heel weight 62. Adjustable preloading is accomplished by screwing threaded toe weight plug 48 and threaded heel weight plug 50 into respective plug receptacles 64 and 66 and tightened to a desired level with a hex head wrench received by toe weight plug hex head wrench socket 52 and heel weight plug hex head wrench socket 54 thereby compressing toe weight 60 and heel weight 62. Front striking face 32 makes a slight angle of about 4° to the horizontal, rearward and upward from slightly radiused lower front edge 44 to aid in imparting overspin to a golf ball. Alignment groove 36 is scribed transversely on top edge surface 34 midway between toe 28 and heel 30 to provide proper orientation of a golf ball with putter head 10 during address.

Conclusion, Ramifications, and Scope of Invention

Accordingly, the invention described above provides a table balanced, adjustable moment of inertia, vibrationally tuned putter. The position of the hosel section is only constrained to be such that the upper hosel stem centerline remain in the center of mass plane. Therefore, many hosel section positions and alignments can be affixed along the top edge surface of the invention without compromising its table balanced feature. The hosel position also promotes a pendulum type stroke that imparts overspin to a golf ball. The adjustable toe and heel weighting allows one to change the weighting and moment of inertia of the putter in an expected manner without altering its balanced feature. The vibrational characteristics of the putter can be changed by the amount of tightening of the weight plugs. Weights of many materials and diameters equal to or less than the weight chamber diameter can be used with the sole restriction that the length of the weight is the same as the weight chamber to prevent rattling of weights.

Thus, the aforementioned objects and advantages are most effectively attained. Although one preferred embodiment of this invention has been disclosed in detail, the scope of the invention should be determined not by the preferred embodiment, but by the following claims and their legal equivalents.

I claim:

1. A golf putter head in combination with a shaft having a grip to form a golf putter, the elements of the golf putter comprising:

(a) an elongated front striking face and elongated rear face defining substantially flat surfaces extending from a heel to a toe, a sole surface being convexly curved from said heel to said toe extending rearwardly from a lower front edge and defining the bottom surface of said golf putter head, an elongated top edge surface extending between said front striking face and said rear face, said shaft having an axial line;

(b) a fixed lengthed toe weight chamber near said toe and a fixed lengthed heel weight chamber near said heel located behind said front striking face, a fixed lengthed toe weight, a fixed lengthed heel weight, a toe weight plug receptacle, a heel weight plug receptacle, a toe weight plug, and a heel weight plug;

(c) a lower hosel stem affixed to said top edge surface extending substantially upward, a hosel offset affixed to said lower hosel stem extending substantially horizontal and rearward, an upper hosel stem affixed to said hosel offset extending substantially upward, and a hosel barrel affixed to said upper hosel stem for affixing said shaft;

(d) a center of mass plane defined as a vertical plane intersecting said toe and said heel elongatedly bisecting said golf putter head into equal amounts of mass on each side of said center of mass plane;

(e) said hosel offset being so positioned such that said axial line of said shaft, longitudinal centerline of said hosel socket, and longitudinal centerline of said upper hosel lie in said center of mass plane;

(f) a table balanced golf putter defined by positioning said golf putter such that said axial line of said shaft is constrained horizontally and unconstrained rotationally resulting in said putter head coming to rest with said center of mass plane parallel to a vertical plane;

(g) a means of securing said toe weight plug and said heel weight plug in said toe weight receptacle and said heel weight receptacle respectfully, for immobilizing said toe weight received by said toe weight chamber, and immobilizing said heel weight received by said heel weight chamber thereby changing the moment of inertia of said putter head in an expected manner;

(h) said toe weight chamber and said heel weight chamber so positioned such that upon receiving said toe weight and said heel weight respectively, said toe weight and said heel weight are bisected by said center of mass plane into equal amounts of mass of said toe weight and said heel weight on cad side of said center of mass plane to maintain the table balanced feature of said golf putter.

2. The golf putter of claim 1, wherein said golf putter head is formed of a metallic material.

3. The golf putter of claim 1, wherein said toe weight, said heel weight, said toe weight chamber, and said heel weight chamber are of cylindrical form such that said center of mass plane is perpendicular to axial lines of said toe weight, said heel weight, said toe weight chamber, and said heel weight chamber.

4. The golf putter of claim 1, further including a weighting means comprising of said toe weight and said heel weight comprised of metallic materials different from metallic material of remaining elements of said golf putter head thereby providing a wide moment of inertia and weighting range.

5. An improved golf putter comprised of the following elements: a front striking face, a rear face, a top edge surface, a sole surface extending rearwardly, a toe, a heel, a hosel section for affixing a shaft having a grip and an axial line in a well known manner, the improvement comprising:

(a) a plurality of weight chambers located behind said front striking lace, a corresponding plurality of weights, a corresponding plurality of weight plug receptacles, and a corresponding plurality of weight plugs;

(b) a lower hosel stem affixed to said top edge surface extending substantially upward, a hosel offset affixed to said lower hosel stem extending substantially horizontal and rearward, an upper hosel stem affixed to said hosel offset extending substantially upward, and a hosel barrel affixed to said upper hosel stem for affixing said shaft;

(c) a center of mass plane defined as a vertical plane intersecting said toe and said heel elongatedly bisecting said golf putter head into equal amounts of mass on each side of said center of mass plane;

(d) said hosel offset being so positioned such that said axial line of said shaft, longitudinal centerline of said hosel socket, and longitudinal centerline of said upper hosel lie in said center of mass plane;

(e) a table balanced golf putter defined by positioning said golf putter such that said axial line of said shaft is constrained horizontally and unconstrained rotationally resulting in said putter head coming to rest with said center of mass plane parallel to a vertical plane;

(f) a means of securing said weight plugs in said weight receptacles for immobilizing said weights received by said weight chambers thereby changing the moment of inertia of said putter head in an expected manner;

(g) said weight chambers so positioned such that upon receiving said weights, said weights are bisected by said center of mass plane into equal amounts of mass of said weights on each side of said center of mass plane to maintain the table balanced feature of said golf putter;

(h) a means of securing said weight plugs in said weight receptacles for compressing said weights received by said weight chambers to a desired level thereby preloading said weights in a manner deterministically changing the vibrational characteristic of said golf putter head.

6. The golf putter head of claim 5, wherein said golf putter head is formed of metallic material.

7. The golf putter head of claim 5, wherein said weights and said weight chambers are of cylindrical form such that axial lines of said weights and said weight chambers are perpendicular to said rear face.

8. The golf putter head of claim 5, further including said weights comprised of metallic materials different from metallic material of remaining elements of said putter head producing a wide range of vibrational characteristics.

9. The golf putter head of claim 5, wherein said golf putter head is comprised of a pair of said weights, a pair of said weight chambers, a pair of said weight plug receptacles, and a pair of said weight plugs, one of the said weights, one of the said weight chambers, one of the said weight plug receptacles and one of the said weight plugs located behind said front striking face near said toe of said golf putter head, and one of the said weights, one of the said weight chambers, one of the said weight plug receptacles, and one of the said weight plugs located behind said front stalking face near said heel of said golf putter head.

* * * * *